United States Patent [19]

Morton et al.

[11] Patent Number: 4,845,789

[45] Date of Patent: Jul. 11, 1989

[54] DYEING OF GARMENTS WITH LOW-SUBSTANTIVITY VAT DYES

[75] Inventors: Glenn P. Morton, Apex; George A. McFadyen, Raleigh, both of N.C.; Rob L. Stone, El Paso, Tex.

[73] Assignee: Cotton Incorporated, New York, N.Y.

[21] Appl. No.: 194,093

[22] Filed: May 16, 1988

Related U.S. Application Data

[63] Continuation-in-part of Ser. No. 854,873, Apr. 23, 1986, Pat. No. 4,756,037.

[51] Int. Cl.[4] ..... D06B 3/30

[52] U.S. Cl. ..... 8/150; 8/159

[58] Field of Search ..... 8/150, 159, 653; 68/9, 68/27, 210

[56] References Cited

U.S. PATENT DOCUMENTS

| | | | |
|---|---|---|---|
| 810,394 | 1/1906 | Cleff . | |
| 1,619,263 | 3/1927 | McFalls | 68/9 |
| 1,873,004 | 8/1932 | Meinig . | |
| 2,450,773 | 10/1948 | Weber . | |
| 3,047,352 | 7/1962 | Santoro et al. . | |
| 3,071,954 | 1/1963 | Grunewald | 68/27 |
| 3,457,022 | 7/1969 | Fields . | |
| 3,470,717 | 10/1969 | Petre | 68/9 |
| 3,576,589 | 4/1971 | Coon . | |
| 3,938,952 | 2/1976 | McNeill . | |
| 4,166,717 | 9/1979 | Fono et al. . | |
| 4,283,194 | 8/1981 | Teague et al. . | |
| 4,310,332 | 1/1982 | Curzons . | |
| 4,342,565 | 8/1982 | Teague et al. . | |
| 4,365,373 | 12/1982 | Witte et al. . | |
| 4,371,373 | 2/1983 | Balland . | |

FOREIGN PATENT DOCUMENTS

| | | |
|---|---|---|
| 1098258 | 3/1981 | Canada . |
| 567839 | 1/1933 | Fed. Rep. of Germany . |
| 1920442 | 4/1969 | Fed. Rep. of Germany . |
| 732993 | 7/1955 | United Kingdom . |

*Primary Examiner*—Harvey C. Hornsby
*Assistant Examiner*—Frankie L. Stinson
*Attorney, Agent, or Firm*—Burns, Doane, Swecker & Mathis

[57] ABSTRACT

The present invention provides a process for the rapid dyeing of a series of successive garments or batches of garments with a vat dye, preferably indigo dye, wherein the garments while contained are submerged in and impregnated with the dyeing solution in a first bath, then removed from it while draining the dyeing solution and conserving it for re-use, then promptly immersed in an oxidizing solution in a second bath so as to shock oxidize the dye present in the garments, then removed from the oxidizing bath while draining the oxidizing solution and preserving it for re-use, and then washed and dried, and wherein the time elapsed between removal of the garments from the dyeing solution and their immersion in the oxidizing solution is less than 5 minutes.

21 Claims, 2 Drawing Sheets

DYEING OF GARMENTS WITH LOW-SUBSTANTIVITY VAT DYES

CROSS-REFERENCE TO RELATED APPLICATION

BACKGROUND OF THE INVENTION

This application is a continuation-in-part of application Serial No. 06/854,873 filed Apr. 23, 1986, now U.S. Pat. No. 4,756,037, issued July 12, 1988.

1. Field of the Invention

This invention relates to a process for dyeing successive batches of garments with a low-substantivity vat dye. The process includes the steps of rapidly impregnating each garment at or near ambient temperature with an aqueous solution of a vat dye and then shock oxidizing essentially all of the vat dye impregnated in the garment.

2. Description of the Prior Art

Indigo dye is a type of vat dye that has been known for centuries. Being a vat dye, indigo is normally insoluble in water but reducible to an amber colored water-soluble form. This soluble form, sometimes referred to as the leuco dye, is used to impregnate fibers with the dye. Subsequent oxidation insolubilizes the leuco dye and produces the final color. In the past, such oxidation has been commonly accomplished by "skying", i.e., by passing dyed yarn or fabric along an extended path through air, but this technique tends to insolubilize the dye mainly at and near the surface and has not been found satisfactory in the case of garments or heavy fabrics.

The use of indigo to dye cotton textiles in raw stock, yarn, and fabric forms is well known. See, e.g., U.S. Pat. Nos. 3,457,022 (Fields); 4,283,194 (Teague et al); and 4,342,565 (Teague et al); and Canadian Patent No. 1,098,258 (Zwier). These methods generally require considerable space and time and consume large amounts of energy due to their use of elevated dyeing or oxidation temperatures. For example, U.S. Pat. No. 3,457,022 describes a process of dyeing cotton yarn wherein indigo is first applied at a temperature of from about 65° to 85° C. The indigo is subsequently oxidized by skying the yarn. In order to produce the final desired color at least at and near the yarn surface, such oxidation by exposure to air is a lengthy procedure that requires several minutes for yarn lengths and on the order of hours for flat fabrics or for garments.

U.S. Pat. Nos. 4,283,194 and 4,342,565 disclose a method of dyeing relatively dry cotton yarns and fabrics wherein the indigo dye vat is maintained at a temperature of from about 55° to 90° C. After dyeing, the indigo dye is oxidized by skying. Chemical oxidation of the dye by use of an oxygen donor such as peroxide is mentioned but no details are given of any such chemical oxidation technique.

Canadian Patent No. 1,098,258 discloses a method for dyeing wet cotton yarn. The yarn is passed in sheet form through a wash box so as to treat the yarn with a wetting agent at about 95° C. With a moisture content of about 50% based on the weight of the yarn, the yarn is cooled to about 20° to 25° C. and fed to at least one indigo dye bath maintained at approximately the same temperature as the cooled yarn. The yarn sheet is subsequently conveyed to an oxidizing tank maintained at about 43° C. wherein the indigo dye is fixed in the yarn by a chemical oxidation agent such as sodium bichromate, sodium perborate, hydrogen peroxide, or mixtures thereof. The patent discloses that the preferred speed of the yarn sheet through the system is 50 yards per minute, or about twice the speed of dyeing yarn in rope form using the skying method of oxidizing.

The dyeing of garments or stockings on hangers or forms has also been disclosed previously. See, e.g., U.S. Pat. No. 1,873,004 (Meinig), German Patent 567,839 published 10 January 1933, and German Patent 1,920,442 published 21 January 1971. However, these references are devoid of any meaningful disclosure of the dyeing conditions, such as dye bath formulation, dye application, immersion times, oxidation of the dye, etc..

Some of the prior art referred to above as well as U.S. Pat. Nos. 810,394 (Cleff), 2,450,773 (Wehr), 3,047,354 (Santoro et al), 3,576,589 (Coon), 3,938,952 (McNeil), 4,166,717 (Fono et al), 4,310,322 (Curzons), 4,365,373 (Witte et al), 4,371,373 (Ballard), and U.K. Patent No. 732,993 (Frowein) were cited during the prosecution of applicants' parent application Ser. No. 854,873 filed Apr. 23, 1986, now U.S. Pat. No. 4,756,037, but these are merely cumulative in one respect or another or only of general interest.

There are several important advantages to dyeing garments with indigo dye as compared to making garments from indigo-dyed yarns or fabric. First, dyeing garments provides market acceptance based on rapid production rates, low capital outlays, and effective inventory control. Second, dyeing garments provides for ease of operation as the labor intensive steps of warp beam make-up and yarn quilling processes are no longer necessary. Third, dyeing garments more easily achieves a desirable color-coordinated effect in dyed garments or set of garments that contain both knit and woven patterns or that comprise jacquard patterns of different types of yarns. Fourth, this technique permits re-dyeing garments which were initially dyed incompletely, or unevenly, or otherwise to an unsatisfactory shade or color.

The advantages and essential characteristics of the garment-dyeing process of the present invention will be apparent from the following detailed description.

OBJECTS AND SUMMARY OF THE INVENTION

In view of the various disadvantages heretofore inherent in vat dyeing textiles in the form of raw stock, yarn, fabric or garment, it is an object of this invention to provide a rapid and economical process for dyeing a series of cellulose-fiber garments, which may be undyed or previously dyed with any kind of dye or pigment, or more particularly batches of such garments.

It is a more specific object to provide a flexible and demand-responsive process for the rapid and economical dyeing of successive cotton garments with a low-substantivity vat dye, especially indigo dye.

It is a further object to provide a process that easily produces color-coordinated items of clothing that contain both knit and woven fabric or patterns or that comprise jacquard patterns of different types of cellulose-fiber yarn.

It is still another object to provide a process for the rapid and economical dyeing of successive garments with indigo while minimizing the formation of oxidation-retarding scum on the garments or on the dye bath.

It is yet another object to provide a process for redyeing and thus salvaging garments which were "seconds"

or otherwise undesirable because of prior unsatisfactory dyeing in a ball warp process, or because of improper stone washing, or because a wrong or imperfect color or shade has been obtained for any other reason.

The present invention provides an effective process for dyeing a series of successive garments or batches of garments made of cellulose fiber-containing fabric, e.g., cotton or rayon, using a low-substantivity vat dye.

More particularly, the process comprises the steps of (a) placing the garment or garments in a container;

(b) immersing the garment or garments in the container at ambient temperature in a first bath comprising an aqueous solution of a low-substantivity vat dye in its leuco form and agitating said garment or garments while keeping the same substantially submerged in said first bath until each garment is substantially uniformly impregnated with the aqueous dye solution;

(c) separating said bath of dye solution from the impregnated garment or garments and conserving the separated dye solution for re-use;

(d) promptly after said separation shock, oxidizing the leuco dye in the impregnated garment or garments by immersing the same while in a container in a second bath comprising an aqueous solution of an oxidizing agent at a predetermined temperature and agitating said second bath while keeping the garment or garments substantially submerged in said second bath until substantially all of the vat dye in each garment is oxidized;

(e) separating the garment or garments containing the oxidized dye from the second bath and conserving the separated oxidizing solution for re-use;

(f) thereafter placing said garment or garments in a water wash zone and washing said garment or garments; and (g) transferring the washed garment or garments to a drying zone and drying the washed garment or garments.

Preferably in such a process the garments are held in contact with the aqueous dye solution in step (b) for a predetermined time ranging from about 1 to about 45 minutes, more preferably 2 to 20 minutes, and in contact with the oxidizing solution in step (e) for a predetermined time ranging from about 2 to about 30 minutes, preferably 5 to 20 minutes, and the garments are rapidly transferred from the dyeing bath and immersed in the oxidizing bath so as to keep their exposure to an oxidizing atmosphere, such as atmospheric air, in this interval to a minimum, e.g., for less than 5 minutes, most preferably less than 3 minutes.

In the most preferred embodiment, the garments are made from cotton, the dye is indigo, and the oxidizing agent is aqueous hydrogen peroxide.

DETAILED DESCRIPTION OF THE INVENTION

Figure 1:
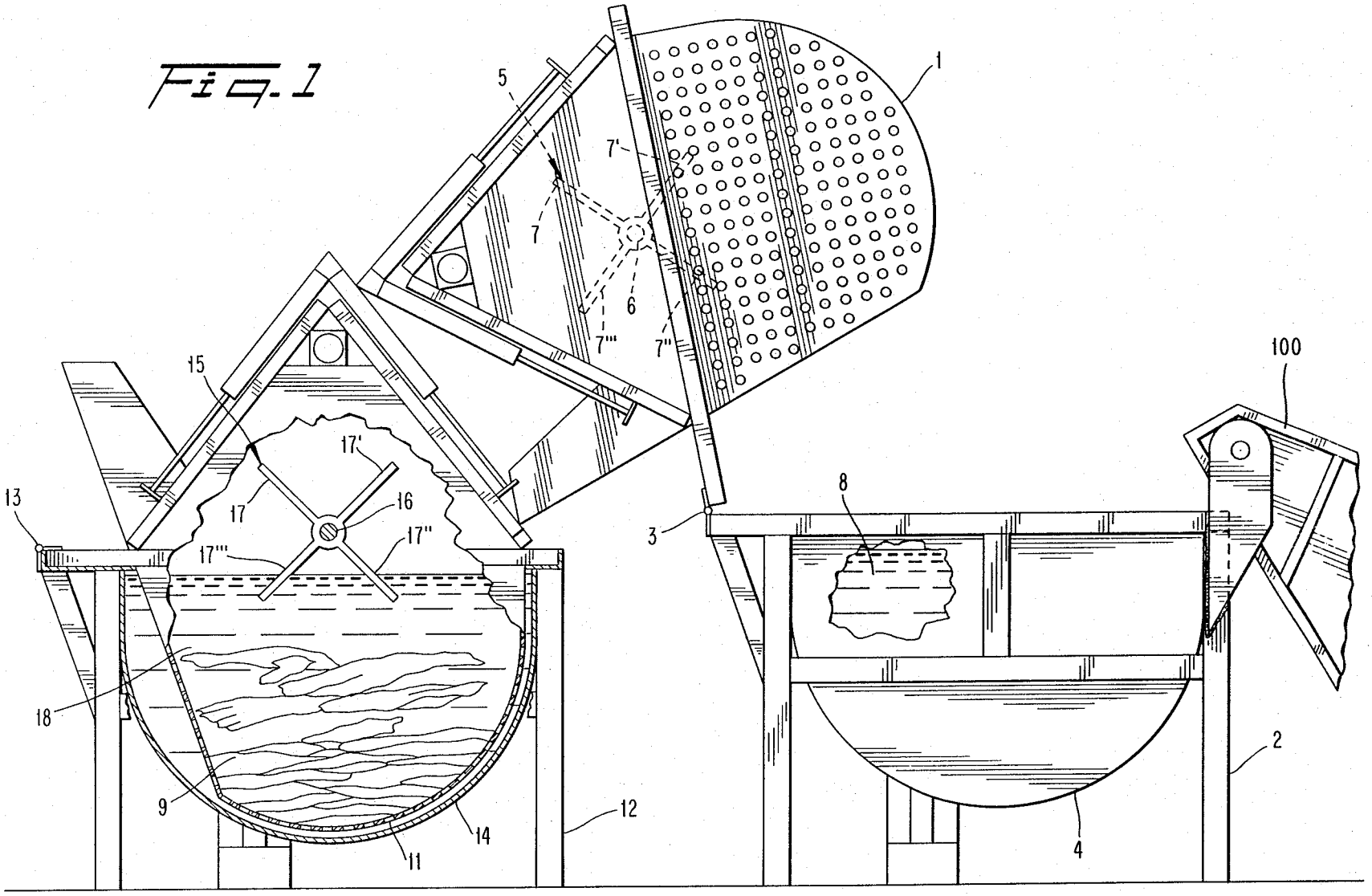
FIG. 1 is a side elevation showing a pair of stainless steel paddle dyeing machines, one serving as a dye impregnation dyeing stage and the other as a dye oxidation stage, each comprising an impervious tub and a foraminous movable container or basket fitting immersibly therein, each container being hinged at its upper edge such that it can be lifted from and lowered into the tub, and each container being fitted with a horizontally rotating paddle wheel for agitating the contents therein.

The process of the present invention relates to the dyeing of a series of successive garments or, more particularly, batches of garments, with a low-substantivity vat dye, e.g., indigo.

The process is particularly suited to vat-dyeing garments made of 100% cotton, but garments constructed of blends of cotton with polyester or other fibers, or of other cellulose fibers, e.g., rayon or its blends with other fibers, also may be dyed using this technique. Moreover, the process may be used not only for previously undyed garments, but also for re-dyeing garments which are undesirable because of faulty prior dyeing or because their color, shade or dyed appearance does not meet current specifications or demand.

As is otherwise well known in the art, the garments to be dyed may initially be scoured in a conventional scour at a temperature up to 100° C., and then washed or rinsed in a series of hot and cold water baths to remove any natural oils and waxes and any additives from prior garment making operations. The scoured garments are then dried to a uniform moisture content equal to or below the normal regain. While garments made from greige (unscoured) fabric may be used without any later scour, prescouring and pre-shrinking of the fabric prior to manufacturing into garments will prevent unwanted shrinkage in the garment dyeing process as well as enhance dyeing quality. Previous scouring and drying of garments ensures thorough and uniform dyeing.

The dye utilized in the present process is a low-substantivity vat dye, e.g., a dye having a substantivity between about "1" and "40", preferably between "2" and "10", according to the BASF standard scale. "Substantivity" is the term used in the art for the attraction of a particular dyestuff for a fiber substrate such as a cotton yarn, fabric or garment. A low substantivity, for example, the value "3" for indigo dye, indicates a low attraction of the dye for the fiber substrate. A vat dye is one that is reduced to a soluble form (leuco form) which, when in aqueous solution, is used to saturate or impregnate the garments. Subsequent oxidation of the leuco dye produces the final color. The vat dyes are well known and include indigo indanthrene and other forms of indigoid and anthraquinone derivatives. The use of indigo is especially preferred in this invention because its low substantivity makes it both initially easy to put on and later easy to take off the surface of the fabric, as by washing down the dyed fabric, whereby a desired "worn" look can be deliberately imparted to the fabric, e.g., denim.

It is possible to use more than one vat dye in the present invention. In such a multi-vat dye process, the different vat dyes can have approximately the same substantivity or substantially different substantivities, as is otherwise well known. In the former instance, the successively dyed batches of garments will be of approximately the same shade as each vat dye will be equally attracted to the garments. In the latter instance, successive batches of garments will differ in shade as the vat dye of higher substantivity is more rapidly attracted to the garment than the less substantive dye, and consequently becomes progressively exhausted from the dye bath unless suitable make-up quantities of it are added. If the same shade is desired throughout a dyeing run, it is well within the ordinary skill in the art to determine empirically the respective amounts of the various individual vat dyes that must be added so that each successive batch of garments is dyed approximately the same desired shade.

The vat dye is used in the present process in the form of an aqueous solution. Preferably, the aqueous solution of the vat dye consists essentially of the vat dye, caustic soda, and a reducing agent, such as sodium hydrosulfite, thereby yielding a reduced dye bath. A typical such aqueous solution comprises about 1 to 15 grams per liter of indigo granules and an appropriate amount of caustic and hydrosulfite to achieve dye reduction, as is otherwise well known. This level of redox potential is preferably maintained at a substantially constant level throughout the process, which can be accomplished by conventionally monitoring the concentration of vat dye and pH by titration or instrumental measurement and continuously recirculating the aqueous dyeing solution. In this manner, garment-to-garment dyeing control is obtained as additional caustic, hydrosulfite, or vat dye is added as necessary.

The aqueous dyeing solution may further comprise any of the known vat dyeing additives such as surfactants, dispersing agents, lubricants, etc.

The addition of a small amount of ammonium hydroxide to the solution can also be advantageous, as the resulting liberation of ammonia gas serves to minimize exposure of the garments to the oxidizing effect of air during the dyeing step.

To ensure the full and even exposure of the fabric surfaces of the garments to the aqueous dyeing solution, the garments must be exposed to the dye solution for a suitable time, preferably by being substantially completely submerged therein with some agitation, so that no significant part of the garment remains undyed or white. Keeping the garments submerged in the dye solution throughout the dyeing step minimizes air oxidation of the dye at the surface of the fabric and thus minimizes the formation of a scum of insoluble dye at the fabric surface. Such scum or surface accumulation of insoluble dye at the fabric surface hinders further penetration of the dye solution into the fabric and thus can result in an inadequately dyed product.

While dye levelness is considered desirable in many cases and can be assured by using the garment dyeing process described in copending application Ser. No. 854,873, now U.S. Pat. No. 4,756,037, perfect dye levelness is not critical and may in fact not always be preferred, as in cases where uneven color effects are deliberately obtained by after-treatment of the indigo dyed garments by conventional "stone washing", "ice washing", "acid washing", "white washing", "snow washing", "sand washing" or the like.

In practicing the present invention, proper exposure of the garments first to the dye and then to the oxidizing solutions and rapid transfer of the garments from one stage of the process to another is preferably obtained by placing the garments in suitably sized containers, such as perforated metal baskets or ladles, or large-mesh baskets woven of rope, or cloth bags. The garments are then impregnated with the proper solution either by immersing them in successive tanks containing a bath of the proper solution, or by immersing them in the same container successively first in a dyeing solution and then in an oxidizing solution.

For instance, one such container may be used for treating the garments in the dye impregnation stage and another such container may be used for treating the garments in the oxidation stage after transfer of the garments from the first container to the other. Alternatively, especially where floor space is limited, it is possible to use a single such container successively both for immersion in the dyeing solution and for immersion in the oxidation solution, provided that suitable piping and storage tanks are provided such that dye solution can first be charged to and discharged from the treating zone where the garments are dyed and oxidizing solution can subsequently be promptly charged to and discharged from the same treating zone for the purpose of oxidizing the vat dye in the dyed garments.

Paddle wheel-agitated machines which represent one kind of equipment suitable for use as treating stages in this invention are schematically illustrated in FIG. 1 of the drawing and are commercially available, for instance, from Rome Machine and Foundry Company, Rome, GA under the name "Rome Hydralift". The baskets, agitators and tubs of such machines may be constructed of any material that is inert to the dyeing and oxidation baths, but equipment constructed of stainless steel is preferred.

Referring to FIG. 1, a dyeing basket 1, made of stainless steel and having perforated end walls as well as a perforated curved bottom, is supported in a metal stand 2 and hinged at 3. This allows it to be lifted for the purpose of discharging from it the garments 9 after they were immersed in the bath of dye 8 and impregnated therein with the leuco dye. The foraminous basket 1 sits within a solid or impervious tank or tub 4 which may be of approximately the same shape as basket 1 or it may be a rectangular tank. Basket 1 is equipped with a motor-driven paddle wheel 5 which extends substantially the full length of the basket 5 and rotates around horizontal axis 6. Its rotating vanes 7, 7', 7'' and 7''' serve to churn or agitate the contents of the basket, thereby assuring thorough contact between the dyeing solution and the batch of garments 9 being dyed. The garments generally stay below the surface of the bath and if they are occasionally floated up to the surface they soon sink back down again, keeping contact with the atmosphere to a minimum. The impregnated garments 9 are discharged from basket 1 into a similarly constructed basket 11, where the garments settle in the oxidizing solution and are oxidized.

Like basket 1, basket 11 is supported in its own metal stand 12, is equipped with a paddle wheel 15 having four vanes 17, 17', 17'' and 17''', hinged at its own hinge 13, and sits inside its own impervious tub 14. In FIG. 1, the paddle dyeing machine comprising basket 2 and tub 4 is shown in the discharge mode, whereas the paddle machine comprising basket 11 and tub 14, is shown in the operating or containment mode after garments 9 have been transferred into it from basket 1.

As basket 1 is raised at the end of the dyeing step, the dyeing solution is drained from it through the perforations into tub 4 underneath, or into some other suitable receptacle for re-use in the next appropriate treatment cycle, and garments 9 are discharged into the next stage, e.g., basket 11. Prompt transfer of the dyed garments from basket 1 upon completion of the dyeing stage into basket 11 and their prompt submersion in the oxidizing solution have the desirable effect of promoting uniform oxidation of the dye throughout the garments and minimizing undesirable scum-forming oxidation at the surface of the fabric. Upon completion of the oxidation stage, basket 11 is lifted from the oxidation bath 18 and discharged into the next stage, e.g., a washing stage 21 as shown in FIG. 2.

Machines of any convenient size may be used. By way of example only, the baskets 1 and 11 may, for instance, be from about 8 to about 10 feet wide , about 5 to 10 feet long, and about 4 to 6 feet deep. The diameter of the paddle wheel may equal about $\frac{1}{3}$ to $\frac{2}{3}$ or more of the width of the basket in which it rotates and its axle is positioned near or above the upper edge of the basket such that the vanes of the wheel extend one foot or more below the level of the bath which they are intended to churn but that they end sufficiently far above the bottom of the basket so that an average load of garments can rest on the bottom of the basket without the garments being picked up by the vanes. 50 to 60 garments represent a typical batch load per machine.

If desired, baskets 4 and 11 may comprise two laterally adjacent sections separated from each other by a vertical, perforated partition (not shown). Such a mechanical embodiment permits simultaneous identical dyeing of two different types of garments in a shared dye bath, e.g., denim trousers in one section and shirts in the other.

Figure 2:
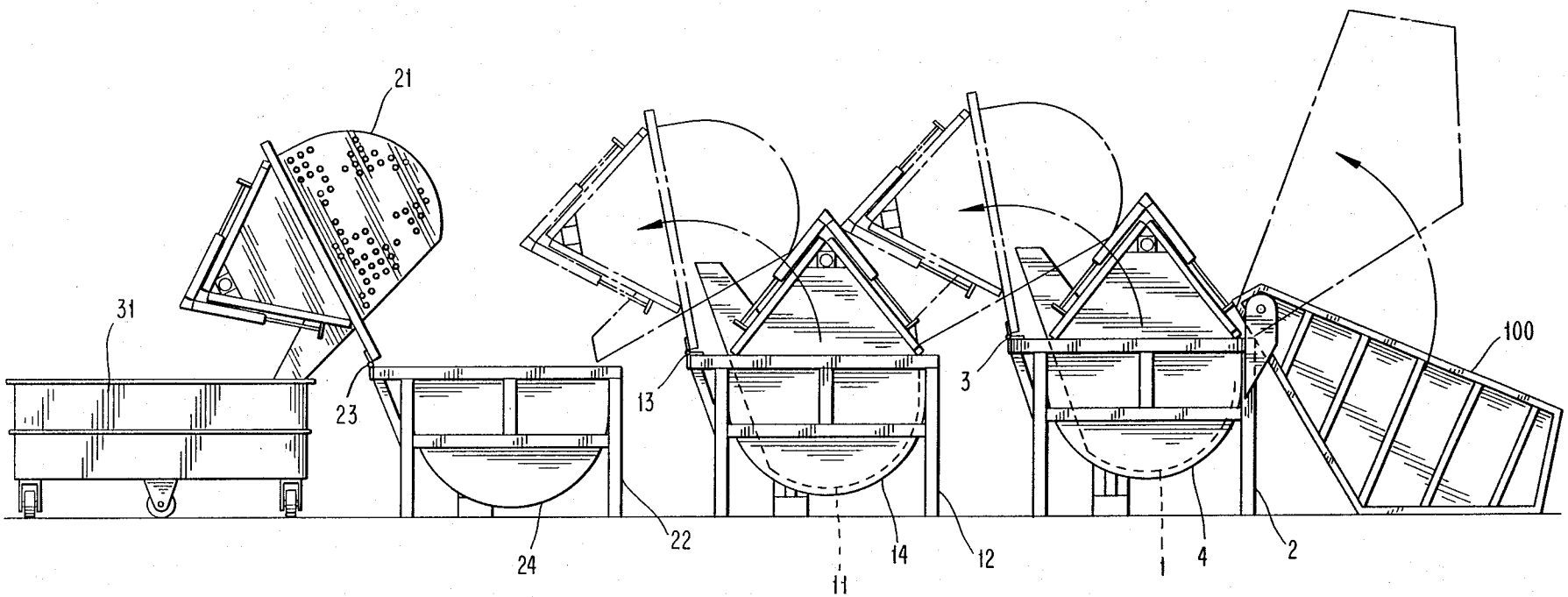
FIG. 2 is a schematic depiction of a system for continuous garment dyeing which comprises a loading hopper, a dye impregnation unit, a dye oxidation unit, a washer, and a wagon for transporting washed garments to a drier or to some other conventional treating stage such as a "stone washing" zone.

A more complete arrangement is shown in FIG. 2, wherein a loading hopper 100 having a hinge 103 permits a batch of garments to be placed in it and then loaded into the foraminous basket 1 of a dye impregnation unit by lifting the hopper 100. Subsequently, the dye-impregnated garments may be discharged similarly from basket 1 to basket 11 of a dye oxidation unit for oxidation and then from basket 11 to washer 21, and finally to cart 31 for transport to a drier or other suitable aftertreating stage.

Instead of dumping the garments directly from one treating stage into the next as illustrated in FIG. 2, it is possible to dump them at the end of each treating step onto a conveyor belt or cart (not shown) and to transport them from one stage to the next in this manner. Indeed, in some cases such a method of transfer may be preferred; especially if several treating lines are run in parallel, because of the greater process flexibility that this allows in case of a breakdown in a particular part of the system.

As still another possibility, one can operate the present process using only a single machine or unit such as basket 1 and tub 4, and to conduct the required treating steps, e.g., dyeing, oxidation and washing, sequentially in such a single unit. In such a case, the tub 4 is connected by means of suitable piping to three separate storage tanks A, B and C (not shown), tank A serving to store the leuco dye solution, tank B the oxidizing solution, and tank C the washing liquid. When operating in such a system, tub 4 is first filled with the dye solution from tank A in advance of the dyeing step, a batch of garments is added, and the dye solution is later drained from tub 4 and pumped back to tank A upon completion of the dyeing step; next tub 4 is filled with oxidizing solution from tank B and the oxidizing solution is later drained from tub 4 and pumped back to tank B upon completion of the dyeing step; and then tub 4 is filled with washing liquid from tank C and the washing liquid is drained from tub 4 and pumped back into tank C upon completion of the washing step. When proceeding in this manner, the garments may either be retained in basket 1 inside tub 4 throughout the entire sequence of steps, or else basket 1 may be lifted from tank 4 while treating solution is drained from the latter. In addition, in the latter case it may be advantageous to rinse tub 4 with washing liquid after dyeing solution has been drained from it and before oxidizing solution is charged into it, as such intermediate washing further minimizes scum formation in tub 4 which tends to occur when undrained remnants of dye solution become mixed in the tub with newly added oxidizing solution.

In one preferred embodiment of the invention, a garment or batch of garments is placed in container 1, the container with the garments is immersed in a first bath that contains the aqueous solution of the leuco dye, and the garments are kept substantially completely submerged in the aqueous solution at ambient temperature, i.e., from about 15° C. to about 40° C., and the solution agitated or churned for from about one to about 45 minutes, more preferably 10 to 30 minutes, until each entire garment is impregnated or saturated with the aqueous dyeing solution. Optimum treating time is determined by the type and quantity of garments treated, the particular composition of dyeing solution, the shade depth desired, the ratio of its volume to the volume of the garments, as well as the configuration of the treating chamber and the nature and intensity of agitation used, but may be routinely determined for any given system by a few preliminary trial runs.

Instead of agitation of the liquor and garments in the basket by means of a paddle wheel, gentle rocking of the foraminous basket 1 while the basket with the garments is submerged inside the solid tub 4 may be used to facilitate full and uniform exposure of each garment to the treating solution.

After impregnation in the aqueous dyeing solution, the garments are promptly discharged from basket 1 to basket 11 where they are immediately immersed in a bath of aqueous oxidizing solution and the leuco dye in the garments is thus shock oxidized by being rapidly impregnated throughout at a predetermined temperature in the oxidizing solution after excess dye solution has been drained from the garments as basket 1 is lifted from the dyeing solution and tipped.

The oxidizing agent can be any conventional water-soluble oxidizer and is preferably colorless, e.g., one that releases oxygen and is selected from the group consisting of hydrogen peroxide, sodium perborate, sodium percarbonate, sodium iodate and mixtures thereof. The predetermined temperature of the aqueous solution of the oxidizing agent may vary from ambient temperature (about 15° to about 30° C.) up to about 60° C. The actual temperature used will depend upon the desired cast or shade of the dyed garments and may again be conventionally determined as a matter of course by the skilled artisan. Generally, a temperature up to about 40° C. is employed. When indigo dye is oxidized at a temperature above about 40° C., the cast of the dyed garments will be tinged with red, which may or may not be considered desirable. As with the aqueous dyeing solution, the aqueous bath of the oxidizing agent is conventionally monitored by titration or instrumental measurement to ensure an adequate oxidation potential of the solution. Typically, recirculation with the addition of fresh solution by means of a pump and suitable piping (not shown) is utilized. As in the dyeing stage, mechanical agitation of the liquor in basket 11 or tumbling of the garments in the oxidizing solution is preferably used to facilitate full exposure of each garment to the oxidizing agent. Minimizing exposure of the dyed garments to air is also desirable in the oxidation stage, but not nearly so important as in the dyeing stage.

By the same token, it is desirable to keep atmospheric exposure of the freshly dyed garments to a minimum in the interval between their removal from the dyeing solution an their immersion in the oxidizing solution. Preferably, such exposure of the leuco dye-containing garments to air or similar oxidizing gas is kept to below 5 minutes, most preferably below 2 minutes.

The aqueous solution of the oxidizing agent may further comprise sodium carbonate, sodium bicarbonate, acetic acid, or other alkaline or acid agent, as may be found desirable. As is otherwise well known, the addition of an alkaline agent tends to stabilize the solution of oxidizing agent but slows down its oxidizing action, whereas the addition of an acid tends to accelerate its oxidizing action and, concomitantly, its exhaustion. A preferred aqueous oxidizing solution consists essentially of 5 to 20 ml/liter of 35% aqueous hydrogen peroxide solution and about 6 g/liter of sodium carbonate.

The residence time of the garments in the oxidizing bath is in typical cases from about 2 to about 45 minutes, preferably from about 2 to about 30 minutes, and most preferably from about 3 to about 15 minutes. In each case, the aqueous solution of the oxidizing agent must oxidize substantially all of the vat dye impregnated in the garment. Such oxidation will properly insolubilize the vat dye and provide the finished garment with the desired dyed appearance.

The garments containing the oxidized dye are then transferred to a water wash system and washed. Any conventional wash system that is able to accommodate garments may be used. A preferred wash system comprises a first rinse with water at room temperature; a second water rinse at about 25° to 40° C.; a third rinse at about 40° C.; and a final soak in water at from about 80° to about 90° C. The final soak is desirably followed by either exhausting a softener or by a wet-on-wet application of fabric softening agent, as is otherwise well known in the art.

After washing, the garments are transferred to a drying system to be dried.

The following examples are given as specific illustrations of the invention. It should be understood, however, that the invention is not limited to the specific details as set forth in the examples.

EXAMPLE I

DYEING USING TWO PADDLE MACHINES

A 100-liter mix of the following aqueous dyeing solution is prepared:

| | |
|---|---|
| Primasol NB-NF* wetting agent | 6 g/l |
| Basol WS* anionic naphthalene condensate dispersing agent | 2 g/l |
| Basokol NBS* anionic polymeric organic acid dispersing agent | 2 g/l |
| Sodium Hydroxide (50% solution) | 12 cc/l |
| Sodium Hydrosulfite | 15 g/l |
| Basophen M* anionic wetting agent | 2 g/l |
| Burst 100** defoaming agent | 2 g/l |
| Indigo Flakes* | 15 g/l |
| Water | Balance to 100 liters |

*Available from and trade name of BASF Corporation, Paramus, New Jersey
**Available from and trade name of Hydrolabs Inc., Patterson, New Jersey Likewise, a 100-liter mix of the following aqueous oxidation solution is prepared:

| | |
|---|---|
| Sodium Carbonate | 6 g/l |
| Hydrogen Peroxide (35%) | 20 cc/l |
| Water | Balance to 100 liters |

Four pairs of 100% cotton jeans and four sweatshirts are dyed together in one batch, using equipment such as that illustrated in FIG. 1 and the following procedure:

1. Add about 50 liters of the dye liquor to tub 4 of the paddle machine;
2. load the jeans and shirts into basket 1 which rests in tub 4, and add 25 additional liters of dye liquor to the machine so that the garments in basket 1 are well covered by liquor;
3. add "Burst 100" defoaming agent to the liquor as needed to control foam;
4. run the paddle wheel continuously for 15 minutes with cycle reversing every 15 seconds;
5. remove garments from the dye liquor and within two minutes place them in basket 11 of a second paddle machine and immerse them in oxidation bath 14 containing 100 liters of the oxidation solution in a separate paddle machine;
6. oxidize the garments in basket 11 of the second paddle machine for 15 minutes with the paddle wheel operating
7. after oxidation, remove the garments in basket 11 from the liquor in tank 14 and wash them at 80° C. for 10 minutes, and dry them.

The appearance of the dyed garments is an excellent indigo blue color with full shade coloration.

EXAMPLE II

DYEING USING A SINGLE PADDLE MACHINE

A 100-liter mix of the following aqueous dyeing solution is prepared:

| | |
|---|---|
| Primasol NB-NF* wetting agent | 6 g/l |
| Basol WS* anionic naphthalene condensate dispersing agent | 2 g/l |
| Basokol NBS* anionic polymeric organic acid dispersing agent | 2 g/l |
| Sodium Hydroxide (50% solution) | 12 cc/l |
| Sodium Hydrosulfite | 15 g/l |
| Basophen M* anionic wetting agent | 2 g/l |
| Burst 100** defoaming agent | 2 g/l |
| Indigo Flakes* | 15 g/l |
| Water | Balance to 100 liters |

Likewise, a 100-liter mix of the following aqueous oxidation solution is prepared:

| | |
|---|---|
| Sodium Carbonate | 6 g/l |
| Hydrogen Peroxide (35%) | 20 cc/l |
| Water | Balance to 100 liters |

Four pairs of 100% cotton jeans and four sweatshirts are dyed in a single batch, using a single paddle machine of the type illustrated in FIG. 1 and the following procedure:

1. add about 50 liters of the dye liquor to tub 4 of the paddle machine;
2. load the jeans or shirts into basket 1 which rests in tub 4, and add more dye liquor to tub 4 so as to provide a bath containing 75 liters of dye solution;
3. add "Burst 100" defoaming agent to the liquor as needed to control foam;

4. run the paddle wheel continuously for 15 minutes, with the cycle reversing every 15 seconds;
5. drain the indigo dye bath from tub 4 to a storage container within a period of about 1.5 minutes;
6. pump 75 liters of oxidation bath into tub 4;
7. oxidize the garments in basket 1 while the garments are submerged in the oxidation bath for about 5 minutes and the oxidation bath is agitated by the paddle wheel;
8. drain the oxidation bath from tub 4 to a storage container;
9. fill tub 4 of the machine with hot water and wash the garments at 80° C. for 10 minutes;
10. unload the garments, extract them and tumble dry them.

The appearance of the indigo dyed garments is a full blue shade.

EXAMPLE III

DYEING USING ROTARY DRUM MACHINE

A 100-liter mix of the following aqueous dyeing solution is prepared:

| | |
|---|---|
| Primasol NB-NF* wetting agent | 6 g/l |
| Basol WS* anionic naphthalene condensate dispersing agent | 2 g/l |
| Basokol MBS* anionic polymeric organic acid dispersing agent | 2 g/l |
| Sodium Hydroxide (50% solution) | 12 cc/l |
| Sodium Hydrosulfite | 15 g/l |
| Basophen M* anionic wetting agent | 2 g/l |
| Burst 100** defoaming agent | 2 g/l |
| Indigo Flakes* | 15 g/l |
| Water | Balance to 100 liters |

Likewise, a 100-liter mix of the following aqueous oxidation solution is prepared:

| | |
|---|---|
| Sodium Carbonate | 6 g/l |
| Hydrogen Peroxide (35%) | 20 cc/l |
| Water | Balance to 100 liters |

Four pairs of 100% cotton jeans and sweatshirts are dyed using a rotary drum machine and the following procedure:

1. place the garment in the drum of the machine;
2. make system oxygen-free by flushing the drum with aqueous ammonia and add pre-vatted indigo liquor to the machine to desired level, i.e., until garments are more than fully submerged in the dye liquor;
3. rotate the machine continuously for 30 minutes, with a cycle reversing every 15 seconds;
4. remove dye liquor from the vessel drum and pass it to storage for use in the next lot;
5. pump oxidation liquor into the drum of the machine and oxidize the garments therein for 15 minutes while the machine rotates;
6. remove the oxidation liquor from the drum and wash the garments in the drum at 80° C. for 10 minutes;
7. after washing the garments, extract them and tumble dry them.

The garments exhibited full shade appearance.

EXAMPLE IV

DYEING ON PIPE RACK

A 200-liter mix of the following aqueous dyeing solution is prepared:

| | |
|---|---|
| Primasol NB-NF* wetting agent | 4 g/l |
| Basol WS* anionic naphthalene condensate dispersing agent | 2 g/l |
| Basokol NBS* anionic polymeric organic acid dispersing agent | 2 g/l |
| Sodium Hydroxide (50% solution) | 12 ml/l |
| Sodium Hydrosulfite | 15 g/l |
| Indigo Flakes | 5 g/l |
| Water | Balance to 200 liters |

Likewise, a 200-liter mix of the following aqueous oxidation solution is prepared:

| | |
|---|---|
| Sodium Carbonate | 8 g/l |
| Sodium Peroxide (35% solution) | 12 ml/l |
| Water | Balance to 200 liters |

Two dozen pairs of 100% cotton pants are dyed using the following procedure and equipment:

1. Two dozen pairs of pants are placed on forms on a common pipe rack and lowered as a unit for 3 minutes into a tank containing reduced vatted indigo dye bath, the rack of garments being fully submerged in the liquor and the liquor being agitated and recirculated;
2. lift the rack and drain the liquor drained from the garments while moving the rack to a second tank, which contains the oxidation liquor; the elapsed time between the lifting of the garments from the dyeing liquor and immersing them in the oxidation liquor is about 30 to 40 seconds;
3. immerse the rack with the garments in the oxidation vessel for shock oxidation, the garments being fully submerged in the oxidation liquor with agitation for 3 minutes;
4. remove the rack with the garments from the oxidation vessel and transfer the same to an area where the garments are removed from the forms;
5. wash the garments in a commercial rotary garment washer;
6. the garments are extracted and tumble dried.

Appearance of the dyed garments is an excellent indigo blue shade.

Although the invention has been described with preferred embodiments, it is to be understood that variations and modifications may be employed without departing from the scope or spirit of this invention as will be apparent to those skilled in the art. Such variations and modification are to be considered within the scope of the appended claims.

What is claimed is:

1. A process for dyeing a series of successive garments with a vat dye of low substantivity, comprising the steps of:

(a) placing a batch comprising at least one garment made of cellulose fiber in a first container;

(b) submerging the garment batch in said container at ambient temperature in a first bath comprising a solution of low-substantivity vat dye in its leuco form and agitating said garment batch while keeping the same submerged in said first bath until each garment in the batch is substantially uniformly impregnated with the aqueous dye solution;

(c) separating the said batch comprising said at least one impregnated garment from said first bath and retaining the first bath for later use;

(d) promptly after said separation submerging said batch comprising said at least one impregnated garment while in a container in a second bath comprising an aqueous solution of an oxidizing agent and agitating said garment batch in said second bath until substantially all the vat dye in the garment is oxidized;

(e) separating the batch comprising said at least one garment containing the oxidized dye from said second bath and retaining said second bath for later use; and (f) thereafter washing said separated batch comprising said at least one garment.

2. A process according to claim 1, wherein the vat dye is selected from the group consisting of indigo, anthraquinone and derivatives thereof and wherein the garment batch is kept submerged in dye solution in step (b) for a period of from about 1 to 45 minutes and the time elapsed between removal of the garments from the dye solution and their submersion in the oxidizing solution in step (d) does not exceed 3 minutes.

3. A process according to claim 2, wherein the garment batch is kept submerged in oxidizing solution in step (d) for a period of from about 2 to 30 minutes.

4. A process according to claim 2, wherein the dye is indigo.

5. A process according to claim 2, wherein the dye is indigo and wherein the oxidizing solution in step (d) is maintained at a temperature between about 15° and about 60° C.

6. A process according to claim 1, wherein separation of garments from dyeing solution and their immersion in oxidizing solution is effected by removing the garments from said first container containing said dye solution and placing them in a second container containing said oxidizing solution.

7. A process according to claim 1, wherein the garments are separated from said dye solution by removing said dye solution from said first container and wherein said dyed garments are subsequently oxidized by introducing a bath of oxidizing agent into the same first container.

8. A process according to claim 1, wherein said first container in step (a) is a closed container and is flushed with aqueous ammonia or with an inert gas to remove oxygen therefrom before garments are contacted therein with dyeing solution.

9. A process for dyeing a series of successive batches of cotton garments with indigo, comprising the steps of:

(a) placing a batch of said garments in a first foraminous container;

(b) submerging said garments in said first container at ambient temperature in a first bath comprising an aqueous solution of an indigo dye and agitating said garments while substantially completely submerged in said dye solution for about 10 to about 30 minutes until all parts of each garment are impregnated with said dye solution;

(c) removing said first container from said impregnated garments from said first bath while said dye solution drains from said first container back into said first bath for re-use in another dyeing cycle;

(d) promptly discharging said separated, impregnated garments from said first container into a second foraminous container and submerging and thereby shock oxidizing said impregnated garments in said second container in a second bath comprising an aqueous solution of an oxidizing agent for about 2 to about 20 minutes at a predetermined temperature and agitating said impregnated garments in said oxidizing solution until substantially all of the indigo dye in each garment is oxidized;

(e) removing said second container with said oxidize garments from said second bath while draining the oxidizing solution back into said second bath for re-use in another oxidizing cycle;

(f) discharging said removed garments from said second container to a washing zone and washing the oxidized garments with water; and (g) transferring the washed garments from the washing zone to a drying zone and drying the washed garments.

10. A process according to claim 9, wherein each 2 garment is in contact with the aqueous indigo dye solution in step (b) for from about 10 to about 20 minutes, and wherein the time elapsed between removal of the garments from the dye bath and their submersion the oxidizing bath does not exceed 5 minutes.

11. The process of claim 9 wherein the aqueous dyeing solution consists essentially of indigo dye, caustic soda and hydrosulfite.

12. The process of claim 9 wherein the oxidizing agent is selected from the group consisting of hydrogen peroxide, alkali metal perborate, alkali metal percarbonate, alkali metal iodate and mixtures thereof.

13. The process of claim 9 wherein said predetermined temperature of the oxidizing bath is from about 25° to about 60° C.

14. The process of claim 9 wherein said predetermined temperature of the oxidizing bath is from 30° to 40° C.

15. The process of claim 9 wherein said predetermined temperature of the oxidizing bath is ambient temperature.

16. A process according to claim 9 wherein the garments to be dyed are previously undyed garments.

17. A process according to claim 9 wherein the garments to be dyed are garments unsatisfactorily dyed in a prior operation.

18. A cyclical process for dyeing a series of successive batches of cotton garments with indigo, wherein each cycle comprises the steps of:

(a) placing a batch comprising a plurality of garments in a foraminous container;

(b) immersing said container in a first bath comprising an aqueous dyeing solution consisting essentially of indigo dye, caustic soda, and hydrosulfite at ambient temperature and agitating said garments while substantially completely submerged in said dyeing solution until each garment is uniformly impregnated with said dyeing solution;

(c) removing the foraminous container with the impregnated garments from said first bath while draining dyeing solution back into said first bath for re-use;

(d) thereafter promptly discharging the impregnated garments from said first container into another foraminous container and immersing said other container with the garments at a predetermined temperature in a second bath comprising an aqueous solution consisting essentially of water, of hydrogen peroxide and sodium carbonate and agitating said garments while submerged in said second bath until substantially all of the indigo dye in each garment is uniformly oxidized;

(e) removing said other container with the oxidized garments from said second bath while draining oxidizing solution back into said second bath for re-use;

(f) discharging the oxidized garments form said other container to a washing zone and washing the oxidized garments with water; and (g) transferring the washed garments to a drying zone and drying the same.

19. A process according to claim 18 wherein the garments are held in the various steps for predetermined time such that in steps (b) and (c) each garment is in contact with the indigo dye solution for from about 10 to about 30 minutes before immersion in the oxidizing solution, in step (d) each garment is in contact with the oxidizing solution for from about 5 to about 15 minutes before being washed, and the elapsed time between removal of the garments from the dye solution in step (b) and the immersion of the garments in the oxidizing solution in step (d) is less than 3 minutes.

20. The process of claim 19 wherein said predetermined temperature in step (d) is from about 25° to about 60° C.

21. The process of claim 19 wherein said predetermined temperature in step (d) is ambient temperature.

* * * * *